US008608212B2

(12) United States Patent
Takeda

(10) Patent No.: US 8,608,212 B2
(45) Date of Patent: Dec. 17, 2013

(54) DOOR CLOSER APPARATUS

(75) Inventor: Norihide Takeda, Kanagawa (JP)

(73) Assignee: Shiroki Corporation, Kanagawa (JP)

( * ) Notice: Subject to any disclaimer, the term of this patent is extended or adjusted under 35 U.S.C. 154(b) by 131 days.

(21) Appl. No.: 13/232,761

(22) Filed: Sep. 14, 2011

(65) Prior Publication Data

US 2012/0061977 A1 Mar. 15, 2012

(30) Foreign Application Priority Data

Sep. 15, 2010 (JP) ..... 2010-206229

(51) Int. Cl.
*E05C 3/06* (2006.01)

(52) U.S. Cl.
USPC ..... 292/201; 292/216; 292/DIG. 23

(58) Field of Classification Search
CPC ..... E05B 81/14; E05B 85/26; E05B 81/06
USPC ..... 292/201, 216, DIG. 23
See application file for complete search history.

(56) References Cited

U.S. PATENT DOCUMENTS 5,118,146 A * 6/1992 Watanuki ..... 292/216
5,411,302 A * 5/1995 Shimada ..... 292/201
5,938,252 A * 8/1999 Uemura et al. ..... 292/201
6,048,002 A * 4/2000 Ohta et al. ..... 292/201
6,519,986 B2 * 2/2003 Wicker ..... 70/237
6,698,804 B2 * 3/2004 Shiota et al. ..... 292/201
6,824,177 B1 * 11/2004 Nass et al. ..... 292/216
2001/0024093 A1 * 9/2001 Naganuma ..... 318/445
2003/0116977 A1 * 6/2003 Erices ..... 292/201

FOREIGN PATENT DOCUMENTS

JP 2006 144 367 * 11/2004
JP 2006-144367 6/2006

* cited by examiner

*Primary Examiner* — Kristina R Fulton
*Assistant Examiner* — Nathan Cumar
(74) *Attorney, Agent, or Firm* — Finnegan, Henderson, Farabow, Garrett & Dunner, L.L.P.

(57) ABSTRACT

A door closer apparatus includes: a pole lever that is rotated by a pole which rotates in the direction opposite from the direction of engaging a latch; a pole lever urging portion that urges the pole lever; a spring that urges the pole lever in the direction of coming into contact with the pole; a stopper that comes into abutment with the pole lever at a half lock position to prohibit the pole lever from rotating in the direction of coming into abutment with the pole; a first switch that is activated in response to the latch positioned in a range from the initial position to a position between the half lock position and the full lock position; and a second switch that is activated in response to the pole lever positioned in a range from a position between the initial position and the half lock position to the full lock position.

6 Claims, 12 Drawing Sheets

DOOR CLOSER APPARATUS

BACKGROUND OF THE INVENTION

1. Field of the Invention

The present invention relates to a door closer apparatus configured to retract a door to a full lock state when the door is closed to a half lock state.

2. Description of the Related Art

A locking apparatus provided on a hinge-type door at an entrance of an automotive vehicle has two locking functions including a full lock function for prohibiting the door from opening in a state in which the door is completely closed, and a half lock function for prohibiting the door from opening in a half-shut state.

Using FIG. 10 to FIG. 12, an example of a locking apparatus as described above will be described. FIG. 10 is a configuration drawing showing an unlocked state of the locking apparatus, FIG. 11 is a configuration drawing showing a half lock state of the locking apparatus shown in FIG. 10, and FIG. 12 is a configuration drawing showing a full lock state of the locking apparatus in FIG. 10.

In FIG. 10, a striker 1 is provided on one of the door and a body. Provided on the other one of the door and the body so as to be rotatable is a latch 5 formed with a groove 3 which allows entry of the striker 1.

The latch 5 is urged in an unlocking direction (the direction indicated by an arrow A in the drawing) which allows the striker 1 to enter the groove 3 by an urging portion, not shown.

A pole 7 is rotatably provided at a position adjacent to the latch 5. The pole 7 is urged in a direction coming into abutment with the latch 5 (the direction indicated by an arrow B in the drawing) by an urging portion, not shown.

Subsequently, when the door is closed, the striker 1 presses a wall surface of the groove 3 of the latch 5, and the latch 5 rotates in a direction opposite from the direction of the arrow A against an urging force of the urging portion. Then, an engaging portion 7*a* of the pole 7 and a half lock engaging portion 3*a* of the wall surface of the groove 3 of the latch 5 engage and a half-locked (half-shut) state which prohibits the door from opening in the half-shut state is achieved as shown in FIG. 11.

When the door is further closed, the striker 1 presses the wall surface of the groove 3 of the latch 5, and the latch 5 further rotates in the direction opposite from the direction of the arrow A against the urging force of the urging portion. Then, the engaging portion 7*a* of the pole 7 and a full lock engaging portion 5*a* of the latch 5 engage and a full lock state which prohibits the door from opening in the state in which the door is completely closed is achieved as shown in FIG. 12.

On the other hand, the door in this configuration may be provided with a door closer apparatus configured to retract the door to the full lock state when the door is closed to a position in the vicinity of the half lock state (half-shut). The retraction of the door of the door closer apparatus is normally performed by driving the latch 5 to rotate.

In the door closer apparatus as described above, detection of the half lock state and the full lock state is performed by using a rotary switch provided on an axis of rotation of the latch 5 for detecting a rotational angle of the latch 5 (see JP-A-2006-144367).

Normally, in the door closer apparatus, a timing to start the retraction of the door is determined by detecting the rotational angle of the latch 5. Having errors to an extent in the timing to start the retraction of the door presents no significant problem.

In contrast, a timing to stop the retraction of the door is immediately after having become the full lock state in order to ensure the locking of the door. Therefore, it is necessary to detect the fact that the door is in the full lock state.

As a method of detecting the full locked state, detecting the pole 7 which engages the latch 5 in the full lock state and rotates significantly is conceivable. However, since the pole 7 engages the latch 5 and rotates significantly even in the half lock state, the full locking cannot be detected only by the movement of the pole 7.

Therefore, the following methods are proposed as methods of detecting the full locking.

(1) A method of detecting the rotation of the latch by the rotary switch.

(2) A method of detecting the rotation of the latch by the rotary switch and detecting also the rotation of the pole.

The method (1) detects the full locking only on the basis of the rotational angle of the latch, the full locking cannot be detected accurately due to the error. The method (2) is capable of detecting the full locking accurately by using a hook and the pole.

Both of the methods (1) and (2) employ the rotary switch for detecting two rotational angles (half locking and full locking) of the latch. The rotary switch is large in size and hence requires a large space for the installation thereof. Since the rotary switch is provided on an axis of rotation of the pole 7, there is a problem in that layout of the locking apparatus is constrained. In addition, the rotary switch is a specific component, and has a problem of being expensive.

BRIEF SUMMARY OF INVENTION

In view of such problems, it is an object of the invention to provide a space-saving and low-cost door closer apparatus with less constrain in layout.

In order to achieve at least one of the objects described above, a door closer apparatus according to an aspect of the invention includes a striker provided on one of a door and a body; a latch provided on the other one of the door and the body, formed with a groove which allows entry of the striker, and capable of rotating from an initial position which allows entry of the striker into the groove to a full lock position which prohibits the striker from coming apart from the groove; a pole provided rotatably and configured to prohibit the latch from rotating by engaging the latch positioned at a half lock position and the full lock position between the initial position and the full lock position; a drive unit configured to drive the latch toward the full lock position; a control unit configured to control the drive of the drive unit; a pole lever provided so as to be rotatable and configured to be rotated by being pressed by the pole which rotates in the direction opposite from the direction of engaging the latch; a pole lever urging portion configured to urge the pole lever in the direction of coming into abutment with the pole; a stopper provided on the latch and configured to come into abutment with the pole lever at the half lock position and prohibit the pole lever from rotating in the direction of coming into abutment with the pole; a first switch configured to be activated in response to the latch positioned in a range from the initial position to a position between the half lock position and the full lock position; and a second switch configured to be activated in response to the pole lever positioned in a range from a position between the initial position and the half lock position to the full lock position.

Other characteristics and advantages of the invention will be further apparent from detailed description given below and attached drawings.

DETAILED DESCRIPTION OF INVENTION

Figure 1:
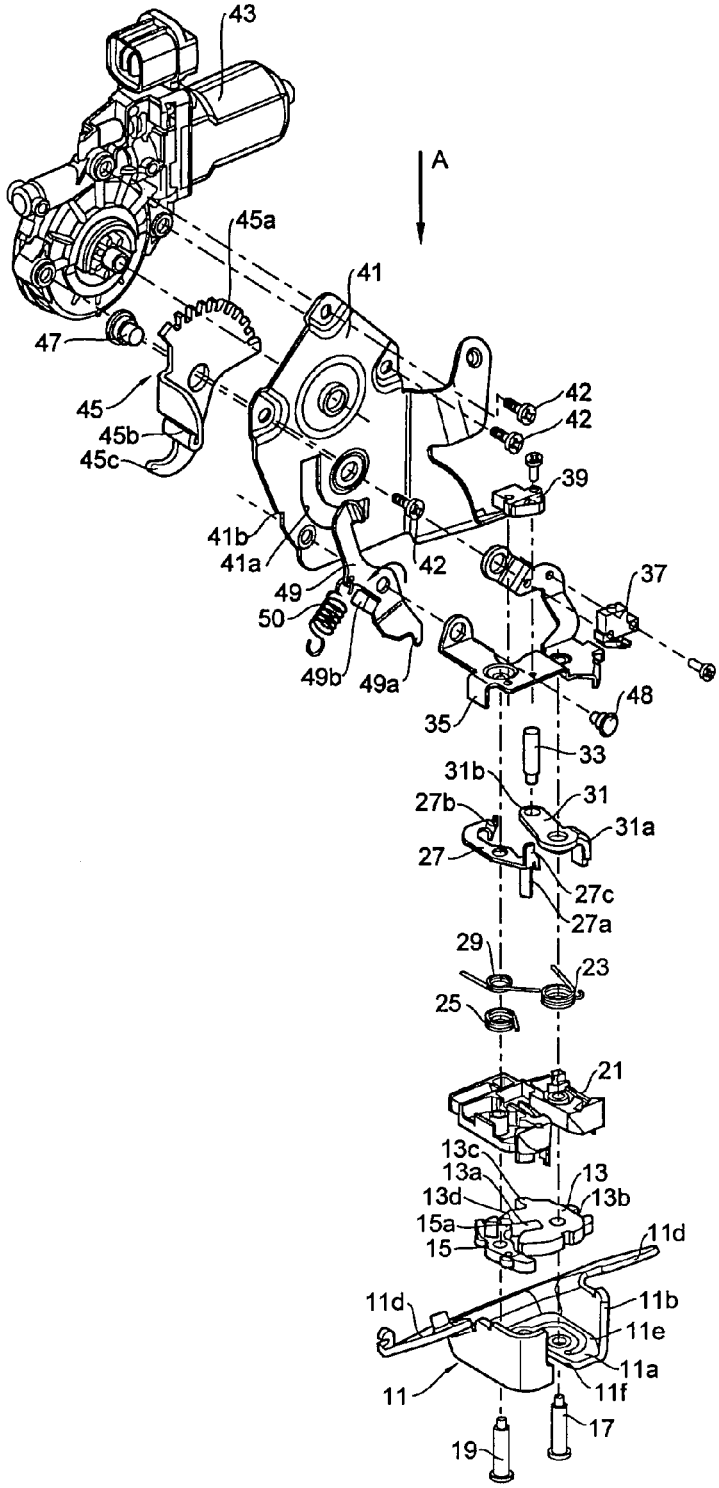
FIG. 1 is an exploded perspective view of a door closer apparatus according to an embodiment.

Referring now to the drawings, an embodiment of the invention will be described.

Referring firstly to FIG. 1, a general configuration of a door closer apparatus according to an embodiment will be described. FIG. 1 is an exploded perspective view of the door closer apparatus according to the embodiment. The door closer apparatus according to the embodiment is provided on a back door. A striker is provided on the side of a body, and the locking apparatus is on the side of the back door.

In FIG. 1, a base 11 provided on the back door includes a base body 11*c* and mounting portions 11*d*. The base body 11*c* includes a bottom portion 11*a* and vertical wall portions 11*b*, and has a box shape opened on one plane. The mounting portions 11*d* are provided continuously from the vertical wall portions 11*b* of the base body 11*c*.

A hole 11*e* is formed on a portion of the vertical wall portions 11*b* of the base body 11*c* facing the striker, not shown, and a groove 11*f* for allowing entry of the striker is formed on the bottom portion 11*a* of the base body 11*c*.

A latch 13 and a pole 15 are arranged on the bottom portion 11*a* of the base body 11*c*. Arranged on one side of the bottom portion 11*a* on the opposite side with respect to the groove 11*f* is the latch 13, and arranged on the other side is the pole 15. The latch 13 is rotatably fitted to a pin 17 attached to the bottom portion 11*a* of the base body 11*c* at one end thereof. The pole 15 is rotatably fitted to a pin 19 attached to the bottom portion 11*a* of the base body 11*c* at one end thereof.

The latch 13 is formed with a groove 13*a* which allows entry of the striker, not shown. Then, the striker is configured to be rotatable from an initial position which allows entry of the striker into the groove 13*a* to a full-locking position which prohibits the striker from coming apart from the groove 13*a* via a half lock position.

Formed on a side portion facing the latch 13 of the pole 15 is an engaging portion 15*a*. The rotation of the latch 13 is prohibited by the engagement of the engaging portion 15*a* with a half lock engaging portion 13*c* of the latch 13 positioned in the half lock position and with a full lock engaging portion 13*d* of the latch 13 positioned at the full lock position.

Provided on the latch 13 and the pole 15 is a body 21. Arranged on the body 21 are a spring 23 and a spring 25. The spring 23 is configured to urge the latch 13 in the direction of the initial position. The spring 25 is configured to urge the pole 15 in the direction in which the engaging portion 15*a* abuts against the latch 13.

Provided on the body 21 is a pole lever 27 provided rotatably with respect to the pin 19. Formed on a rotating end portion on one end of the pole lever 27 is a bent portion 27*a* which is bent toward the pole 15 and can come into abutment with the pole 15 via the body 21. The bent portion 27*a* is capable of coming into abutment with the side portion of the pole 15 facing the latch 13. More specifically, the bent portion 27*a* is capable of coming into abutment with the side of the pole 15 opposite from the side where the engaging portion 15*a* is provided with respect to an axis of rotation thereof. Therefore, the pole lever 27 is configured to be rotatable by being pushed by the pole 15 rotating in the opposite direction from the direction of engaging the latch 13. Then, the pole lever 27 is urged by a spring 29 in the direction in which the bent portion 27*a* comes into abutment with the side portion of the pole 15. More specifically, formed on the rotating end portion on one end of the pole lever 27 is a switch abutting portion 27*c* bent in the opposite direction from the bent portion 27*a*.

Provided on the body 21 is a latch lever 31 provided rotatably with respect to the pin 17. Formed on a rotating end portion on one end of the latch lever 31 is a bent portion 31*a* which is capable of coming into abutment with the latch 13 via the body 21. The bent portion 31*a* is formed on a side portion of the latch 13 and is fitted to a groove 13*b* between two projections arranged side by side in the direction of the axis of rotation. Accordingly, the latch 13 and the latch lever 31 rotate integrally with each other. A pin 33 is provided so as to extend upright on the rotating end portion of the latch lever 31. In addition, the rotating end portion of the latch lever 31 serves as a stopper portion 31*b* which is capable of coming into abutment with a cancel portion 27*b* formed on the other rotating end portion of the pole lever 27.

Provided on the opened plane of the base body 11*c* is a base 35 extending substantially parallel to a plane of rotation of the latch 13 and the pole 15. The other end portions of the pin 17 and the pin 19 are attached to the base 35.

The base 35 is provided with a first microswitch (first switch) 37. The first microswitch (first switch) 37 is a switch which allows abutment of the pin 33 of the latch lever 31, and when in abutment, is activated in response thereto, and is turned OFF. In this embodiment, the latch lever 31 is formed so that when the latch 13 is moved from the initial position to a position between the half lock position and the full lock position, the first microswitch 37 is activated in response. Furthermore, in this embodiment, when the latch 13 is positioned between the half lock position and the full lock position, control to turn on a warning lamp notifying the half-shut and control to turn off a room lamp are performed using the first microswitch 37 activated in response.

In addition, the base 35 is provided with a second microswitch (second switch) 39. The second microswitch 39 is a switch which allows abutment of the switch abutting portion 27*c* of the pole lever 27, and when in abutment, is activated in response thereto, and is turned ON. In this embodiment, the pole lever 27 is formed so that when the pole lever 27 is positioned in a range from a position between the initial position to a position between the half lock position to a position immediately before reaching the full lock position, the second microswitch 39 is activated in response correspondingly.

The base 35 is provided with a bracket 41. The bracket 41 is positioned on a plane substantially vertical to the plane of rotation of the latch 13 and the pole 15. Mounted with three screws 42 on one of the surfaces of the bracket 41 (the back surface in the drawing) is a motor unit (drive unit) 43 including a motor and a speed reducer integrally to each other. Mounted rotatably on the one of the surfaces of the bracket 41 using a pin 47 is a gear lever 45. Formed on a rotating end portion of the gear lever 45 on one side is a sector gear 45*a* which engages a pinion 43*a* attached to an output shaft of the motor unit 43. The bracket 41 is formed with an arcuate hole 41*a* centered on the pin 47. Formed on the rotating end portion of the gear lever 45 on the other side is a bent portion 45*b* projecting toward the other surface of the bracket 41 via the hole 41*a*. The bent portion 45*b* presses the pin 33 of the latch lever 31 by the rotation of the gear lever 45, and is configured to drive the latch 13 toward the full lock position against an urging force of the spring 23.

Mounted rotatably on the other surface of the bracket 41 (the front surface in the drawing) using a pin 48 is a release lever 49. One of rotating portions of the release lever 49 is formed with a pole abutting portion 49*a* which can come into abutment with the pole 15. When the release lever 49 rotates clockwise in the drawing (in the direction opposite from the arrow in the drawing), the pole 15 rotates in the direction in which the engaging portion 15*a* is moved away from the latch 13 against an urging force of the spring 25. The release lever 49 is also formed with a stopper portion 49*b* bent toward the bracket 41. In addition, the other end portion of a spring 50 engaged at one end portion thereof with the base 11 side is locked with the other rotating end portion of the release lever 49. Therefore, the release lever 49 is urged in the direction in which the pole abutting portion 49*a* is moved away from the pole 15 (the direction indicated by the arrow in the drawing: counterclockwise direction), and the stopper portion 49*b* is in abutment with a stopper abutting portion 41*b* formed on the bracket 41. The stopper portion 49*b* of the release lever 49 allows abutment of a release portion 45*c* formed on the other rotating end portion of the gear lever 45. Then, when the release portion 45*c* of the gear lever 45 presses the stopper portion 49*b* of the release lever 49, the release lever 49 rotates clockwise in the drawing (in the opposite direction of the direction indicated by the arrow in the drawing) against an urging force of the spring 50 to rotate the pole 15 in the direction in which the engaging portion 15*a* is moved away from the latch 13 against the urging force of the spring 25.

Figure 2:
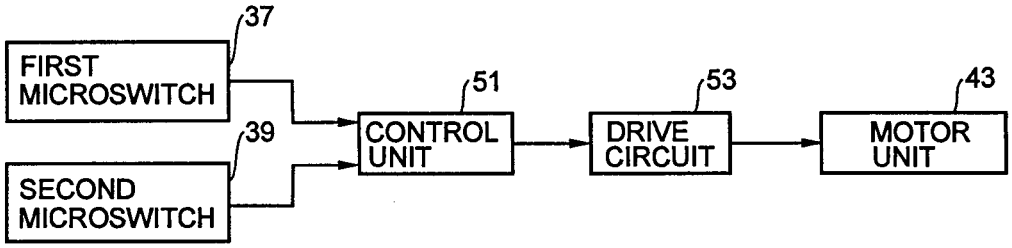
FIG. 2 is an explanatory drawing showing an electric configuration of the door closer apparatus shown in FIG. 1.

Referring now to FIG. 2, an electrical configuration of the embodiment will be described. In the drawing, reference numeral 51 designates a control unit configured to control a drive circuit 53 which acquires signals from the first microswitch 37 and the second microswitch 39, supplies an electric current to the motor unit 43, and drives the motor unit 43.

Figure 3:
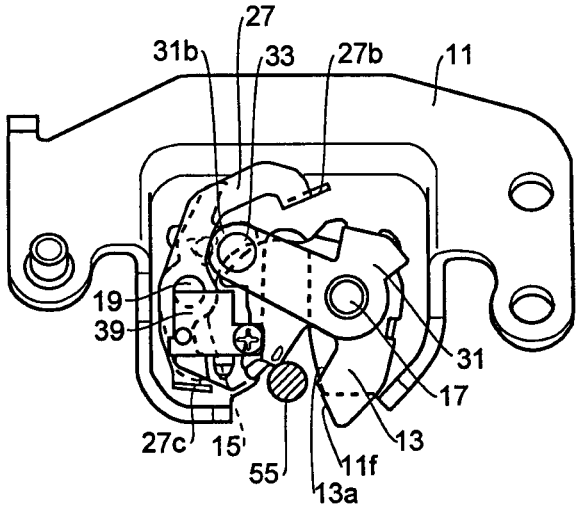
FIG. 3 is an explanatory drawing showing a state in which a latch is located at an initial position where a striker of the door closer apparatus shown in FIG. 1 can enter a groove of the latch.
Figure 4:
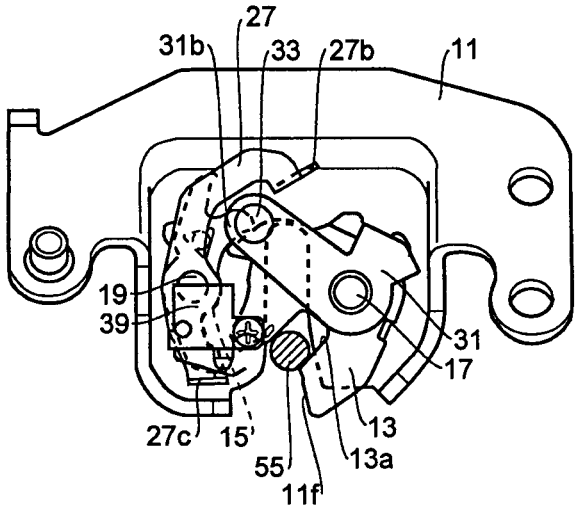
FIG. 4 is an explanatory drawing showing a state in which the striker of the door closer apparatus shown in FIG. 1 enters the groove of the latch and the latch is slightly rotated.
Figure 5:
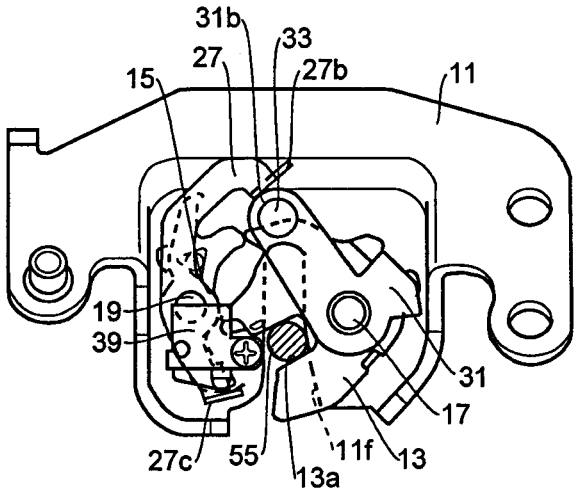
FIG. 5 is an explanatory drawing showing a state immediately before the door closer apparatus shown in FIG. 1 reaches a half lock state.
Figure 6:
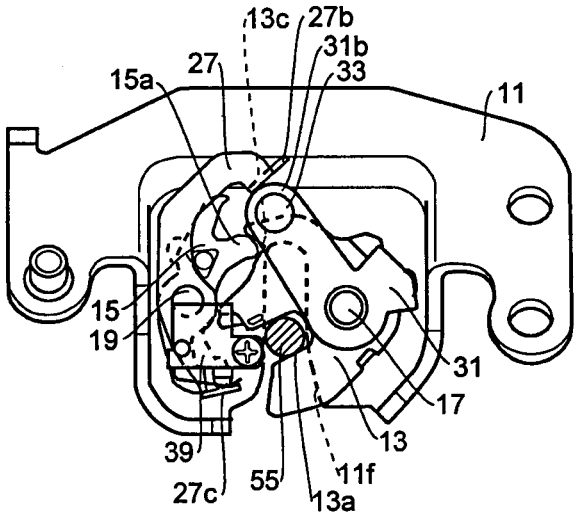
FIG. 6 is an explanatory drawing showing a state in which the door closer apparatus shown in FIG. 1 is in the half lock state.
Figure 7:
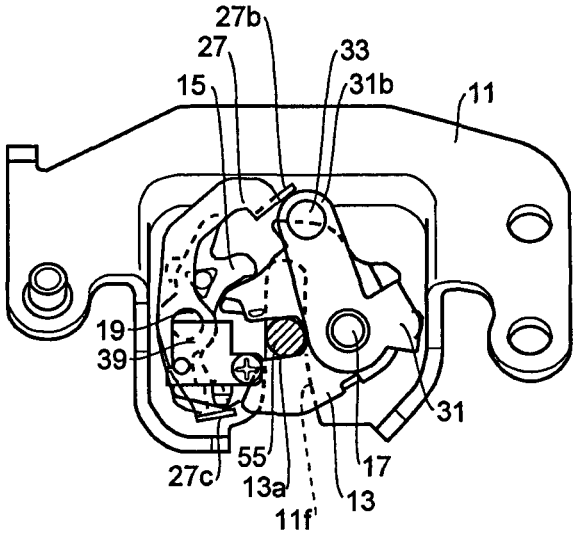
FIG. 7 is an explanatory drawing showing a state immediately before the door closer apparatus shown in FIG. 1 reaches a full lock state.
Figure 8:
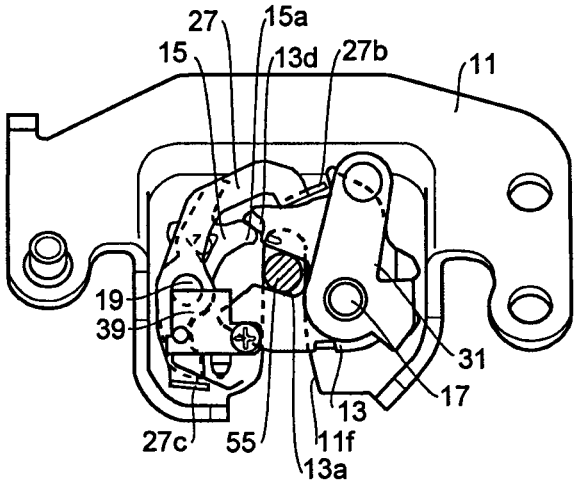
FIG. 8 is an explanatory drawing showing a state in which the door closer apparatus shown in FIG. 1 is in the full lock state.
Figure 9:
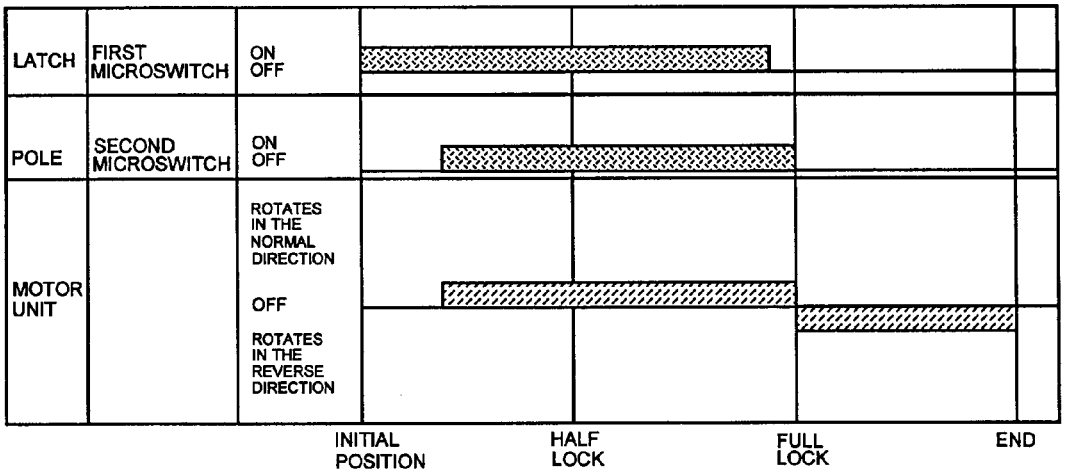
FIG. 9 is a timing chart of explaining an operation of a control unit.
Figure 10:
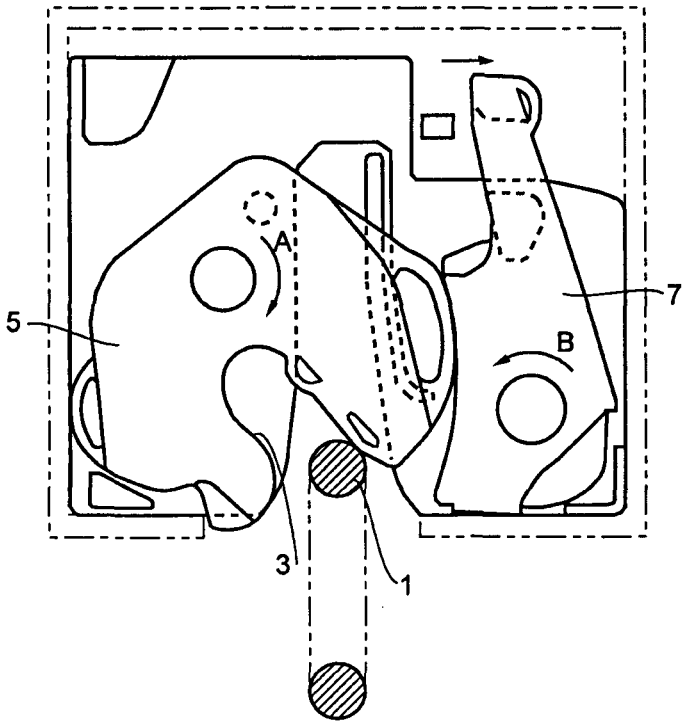
Fig.10 PRIOR ART
FIG. 10 is a configuration drawing showing a state in which a locking apparatus is in an unlock state.
Figure 11:
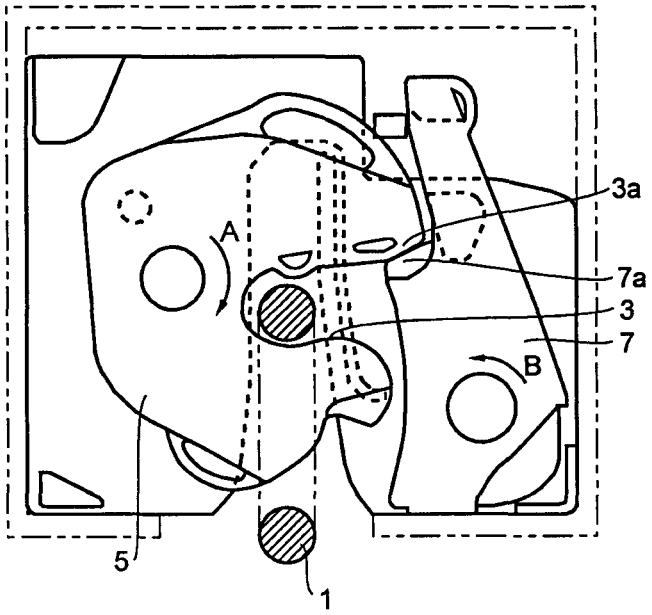
Fig.11 PRIOR ART
FIG. 11 is a configuration drawing showing a state in which the locking apparatus shown in FIG. 10 is in a half lock state.
Figure 12:
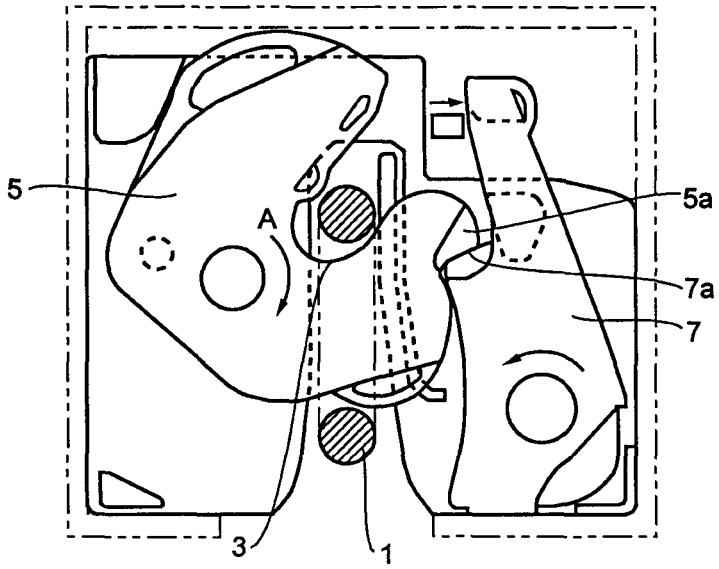
Fig.12 PRIOR ART
FIG. 12 is a configuration drawing showing the locking apparatus shown in FIG. 10 is in a full lock state.

Referring next to FIGS. 3 to 9, an operation of the door closer apparatus having the configuration described above will be described. FIG. 3 is an explanatory drawing showing a state in which the latch in the initial position which allows the striker to enter the groove of the latch, FIG. 4 is an explanatory drawing showing a state in which the striker enters the groove of the latch and the latch is slightly rotated, FIG. 5 is an explanatory drawing showing a state immediately before reaching the half lock state, FIG. 6 is an explanatory drawing showing a state of being in the half lock state, FIG. 7 is an explanatory drawing showing a state immediately before reaching the full lock state, FIG. 8 is an explanatory drawing showing a state of being in the full lock state, and FIG. 9 is a timing chart for explaining the operation of the control unit. FIGS. 3 to 8 are drawings corresponding to FIG. 1 with the base 35, the body 21, the spring 23, the spring 25, the spring 29 and the second microswitch 39 removed therefrom and viewed from the direction indicated by the arrow A.

(Initial Position)

Referring now to FIG. 3 and FIG. 9, description will be given below.

In FIG. 3, the door is opened, and the latch 13 is in the initial position which allows entry of a striker 55 into the groove 13*a* of the latch 13 by the urging force of the spring 23. At this time, the pin 33 of the latch lever 31 is moved away from the first microswitch 37, not shown in FIG. 3, and the first microswitch 37 is in the ON state.

The bent portion 27*a* of the pole lever 27 is in abutment with the side portion of the pole 15 by an urging force of the spring 29, and the switch abutting portion 27*c* of the pole lever 27 is at a position away from the second microswitch 39 and the second microswitch 39 is in the OFF state.

As shown in FIG. 9, when the first microswitch 37 is in the ON state and the second microswitch 39 is in the OFF state, the control unit 51 does not drive the motor unit 43.

(START DOOR CLOSER OPERATION)

Referring now to FIG. 4 and FIG. 9, description will be given below.

In FIG. 4, the striker 55 enters the groove 13*a* of the latch 13, the striker 55 presses the wall surface of the groove 13*a*, and the latch 13 is slightly rotated clockwise. At this time, the pin 33 of the latch lever 31 is at a position away from the first microswitch 37, and the first microswitch 37 is still in the ON state.

The pole 15 rotates counterclockwise by the clockwise rotation of the latch 13. The pole lever 27 also rotates counterclockwise together with the pole 15, the switch abutting portion 27*c* of the pole lever 27 presses the second microswitch 39, and the second microswitch 39 is activated in response and is brought into the ON state.

As shown in FIG. 9, when the first microswitch 37 is in the ON state, and the second microswitch 39 is brought into the ON state, the control unit 51 rotates the motor unit 43 in the normal direction via the drive circuit 53.

When the motor unit 43 rotates in the normal direction, the gear lever 45 rotates counterclockwise in FIG. 1, and the bent portion 45*b* of the gear lever 45 presses the pin 33 of the latch lever 31, and the latch 13 is driven to the full lock position.

(Immediately Before Reaching Half Lock State)

Referring now to FIG. 5 and FIG. 9, description will be given below.

As shown in FIG. 5, when the motor unit 43 rotates in the normal direction, the latch 13 is driven to the full lock position, and the half lock engaging portion 13*c* of the latch 13 and the engaging portion 15*a* of the pole 15 are brought into a state immediately before coming into the engagement, that is, immediately before reaching the half lock position, the stopper portion 31*b* of the latch lever 31 comes into abutment with the cancel portion 27*b* of the pole lever 27. Accordingly, the rotation of the pole lever 27 caused by being pressed by the pole 15 is prohibited. In other words, the rotation of the pole lever 27 urged in the direction in which the bent portion 27*a* comes into abutment with the side portion of the pole 15 is prohibited by the spring 29, and the pole lever 27 maintains its position.

At this time, the pin 33 of the latch lever 31 is moved away from the first microswitch 37, and the first microswitch 37 is still in the ON state. The switch abutting portion 27*c* of the pole lever 27 presses the second microswitch 39, and the second microswitch 39 is still in the ON state.

As shown in FIG. 9, since the first microswitch 37 is in the ON state, and the second microswitch 39 is brought into the ON state, the control unit 51 continues to rotate the motor unit 43 in the normal direction via the drive circuit 53.

(Half Lock State)

Referring now to FIG. 6 and FIG. 9, description will be given below.

As shown in FIG. 6, when the motor unit 43 further rotates in the normal direction from the state shown in FIG. 5, the half lock state in which the half lock engaging portion 13*c* of the latch 13 and the engaging portion 15*a* of the pole 15 are engaged is assumed. With this engagement, the pole 15 rotates significantly clockwise, while the pole lever 27 is prohibited from rotating together with the pole 15 by the latch lever 31 and maintains its position.

At this time, the pin 33 of the latch lever 31 is moved away from the first microswitch 37, and the first microswitch 37 is in the ON state. The switch abutting portion 27*c* of the pole lever 27 presses the second microswitch 39, and the second microswitch 39 is still in the ON state.

As shown in FIG. 9, since the first microswitch 37 is in the ON state, and the second microswitch 39 is brought into the ON state, the control unit 51 continues to rotate the motor unit 43 in the normal direction via the drive circuit 53.

(Immediately Before Reaching Full Lock State)

Referring now to FIG. 7 and FIG. 9, description will be given below.

As shown in FIG. 7, when the motor unit 43 further rotates in the normal direction from the state shown in FIG. 6, the engagement between the half lock engaging portion 13*c* of the latch 13 and the engaging portion 15*a* of the pole 15 is released and the latch 13 further rotates toward the full lock position. When the full lock engaging portion 13*d* of the latch 13 and the engaging portion 15*a* of the pole 15 are about to engage, that is, are brought into a state immediately before reaching the full lock position, abutment between the stopper portion 31*b* of the latch lever 31 which prohibits the rotation of the pole lever 27 and the cancel portion 27*b* of the pole lever 27 is brought into a state immediately before being released.

At this time, the pin 33 of the latch lever 31 presses the first microswitch 37, and the first microswitch 37 is activated in response and brought into the OFF state. The switch abutting portion 27*c* of the pole lever 27 presses the second microswitch 39, and the second microswitch 39 is still in the ON state.

As shown in FIG. 9, when the first microswitch 37 is in the OFF state, and the second microswitch 39 is still in the ON state, the control unit 51 continues to rotate the motor unit 43 in the normal direction via the drive circuit 53.

(Full Lock State)

Referring now to FIG. 8 and FIG. 9, description will be given below.

As shown in FIG. 8, when the motor unit 43 further rotates in the normal direction from the state shown in FIG. 7, the full lock state in which the full lock engaging portion 13*d* of the latch 13 and the engaging portion 15*a* of the pole 15 are engaged is assumed. In this state, the abutment between the stopper portion 31*b* of the latch lever 31 and the cancel portion 27*b* of the pole lever 27 is released, and the pole lever 27 rotates significantly until the bent portion 27*a* comes into abutment with the side portion of the pole 15 by the urging force of the spring 29.

By the rotation of the pole lever 27, the switch abutting portion 27*c* is moved away from the second microswitch 39, and the second microswitch 39 is brought into the OFF state. The pin 33 of the latch lever 31 presses the first microswitch 37, and the first microswitch 37 is activated in response and brought into the OFF state.

As shown in FIG. 9, when the first microswitch 37 is brought into the OFF state, and the second microswitch 39 is also brought into the OFF state, the control unit 51 stops the normal rotation of the motor unit 43, that is, stops the latch 13 from moving toward the full lock position.

The control unit 51 stops the motor unit 43, and rotates the motor unit 43 in the reverse direction by a predetermined angle or for a predetermined period. When rotating in the reverse direction by the predetermined angle, it is achieved by using a Hall IC (a packaged element including a Hall element and an IC configured to convert output signals from the Hall element into digital signals) integrated in the motor unit 43. When rotating in the reverse direction for the predetermined period, it is achieved by using a timer.

In this configuration, the following effects are achieved.

(1) Owing to the stopper portion 31*b* of the latch lever 31, the pole lever 27 is prevented from rotating together with the latch in the half lock state. In contrast, the pole lever 27 rotates together with the pole 15 by the urging force of the spring 29 in the full lock state. In other words, the pole 15 does not rotate in the half lock state, and rotates significantly in the full lock state. Therefore, the full lock state is detected only by the pole lever 27.

Also, the full lock state can be detected accurately by using the first microswitch 37 and the second microswitch 39 which is activated in response to the movement of the pole lever from the position between the initial position and the half lock position to the full lock position.

Since the detection of the rotation of the pole 15 is possible with a small switch such as a microswitch, space saving is achieved. Since the installation on the axis of rotation of the pole 15 is not required, constraint in layout is reduced.

(2) By using the first microswitch 37 and the second microswitch 39, cost reduction is achieved.

(3) By exercising control to turn on the warning lamp which notifies the half-shut state and control to turn off the room lamp using the first microswitch 37 which is activated when the latch 13 is positioned between the half lock position and the full lock position, provision of a switch which detects the half-shut (courtesy switch) separately is no longer necessary, which contributes to the cost reduction.

(4) Since a rotary switch has a structure to allow entry of members which transmit the rotation into the interior thereof, making the rotary switch watertight is difficult. However, since the microswitch can be made watertight easily, watertight of the door closer apparatus can be achieved easily.

The present invention is not limited to the above-described embodiment. In the embodiment described above, the microswitches are employed as the first switch and the second switch. However, a limit switch, a touch switch, a non-contact proximity switch, or a photoelectric sensor may also be employed. The invention is not limited to the embodiment described above, various modification may be made within the scope of the spirit of the invention and description in Claims.

This application is based on Japanese Patent Application serial no.2010-206229 filed on Japan Patent Office on Sep. 15, 2010, the contents of which are hereby incorporated by reference.

What is claimed is:

1. A door closer apparatus comprising:

a striker provided on one of a door and a body;

a latch provided on the other one of the door and the body, formed with a groove which allows entry of the striker, and capable of rotating from an initial position which allows entry of the striker into the groove to a full lock position which prohibits the striker from coming apart from the groove;

a pole provided rotatably and configured to prohibit the latch from rotating by engaging the latch positioned at a half lock position between the initial position and the full lock position and the full lock position;

a drive unit configured to drive the latch toward the full lock position;

a control unit configured to control the drive of the drive unit;

a pole lever provided so as to be rotatable and configured to be rotated by being pressed by the pole which rotates in the direction opposite from the direction of engaging the latch;

a pole lever urging portion configured to urge the pole lever in the direction of coming into abutment with the pole;

a stopper provided on the latch and configured to come into abutment with the pole lever at the half lock position and to prohibit the pole lever from rotating in the direction of coming into abutment with the pole;

a first switch configured to be activated in response to the latch positioned in a range from the initial position to a position between the half lock position and the full lock position; and a second switch configured to be activated in response to the pole lever positioned in a range from a position between the initial position and the half lock position to the full lock position.

2. The door closer apparatus according to claim 1, wherein the control unit acquires signals from the first switch and the second switch and drives the drive unit so as to move the latch toward the full lock position when the second switch is activated in response to the pole lever in a state in which the first switch is activated response to the latch, and when the activation of the first switch in response to the latch is stopped and the activation of the second switch in response to the pole lever is stopped, the latch is stopped to be moved toward the full lock position.

3. The door closer apparatus according to claim 2, wherein at least one of turning on of a half-shut warning lamp or turning off of a room lamp is performed by the activation of the first switch in response to the latch.

4. A door closer apparatus comprising:

a striker provided on one of a door and a body;

a latch provided on the other one of the door and the body, the latch having a groove for engaging with the striker, the latch being rotatable from an initial position which allows entry of the striker into the groove, to a full lock position which prohibits the striker from coming apart from the groove;

a rotatable pole engaging the latch at a half lock position and the full lock position to prohibit rotation of the latch, the half lock position being a position between the initial position and the full lock position;

a drive unit configured to drive the latch toward the full lock position;

a control unit configured to control the drive unit;

a rotatable pole lever which, upon being pressed by the pole, rotates in a direction opposite to that of the latch;

a pole-lever-urging member configured to urge the pole lever to move in a direction that allows the pole lever to abut the pole;

a stopper provided on the latch and configured such that the stopper abuts the pole lever at the half lock position and prohibits the pole lever from rotating and abutting the pole;

a first switch which becomes activated when the latch is positioned between the initial position and a position between the half lock position and the full lock position; and a second switch which becomes activated when the pole lever is positioned between the initial position and a position between the half lock position and the full lock position.

5. The door closer apparatus according to claim 4, wherein the control unit acquires signals from the first switch and the second switch and drives the drive unit so as to move the latch toward the full lock position when the second switch is activated in response to the pole lever and the first switch is activated response to the latch, and wherein when the first switch and the second switch are deactivated, the latch is stopped from moving toward the full lock position.

6. The door closer apparatus according to claim 5, wherein at least one of turning on of a half-shut warning lamp or turning off of a room lamp is performed by the activation of the first switch in response to the latch.

* * * * *